United States Patent [19]

Adicoff et al.

[11] 4,193,952

[45] Mar. 18, 1980

[54] EXTRUSION OF SOLID PROPELLANT INCLUDING AMMONIUM PERCHLORATE WHISKERS

[75] Inventors: Arnold Adicoff; William G. Finnegan; William R. McBride, all of China Lake; William M. Ayres, Ridgecrest, all of Calif.

[73] Assignee: The United States of America as represented by the Secretary of the Navy, Washington, D.C.

[21] Appl. No.: 250,407

[22] Filed: May 4, 1972

[51] Int. Cl.[2] ..... C06B 21/00; C06B 45/10

[52] U.S. Cl. ..... 264/3 B; 149/19.4; 149/19.9; 149/19.91; 149/19.92; 149/21; 149/76; 149/113

[58] Field of Search ..... 264/3 R, 3 B; 149/2, 149/19, 44, 76, 21, 113, 19.9, 19.91, 19.4, 19.92

[56] References Cited

U.S. PATENT DOCUMENTS

| | | | |
|---|---|---|---|
| 3,311,678 | 3/1967 | Brock et al. | 264/3 R |
| 3,359,350 | 12/1967 | Godfrey | 264/3 R |
| 3,454,437 | 7/1969 | Yamazaki et al. | 149/19 X |
| 3,619,305 | 11/1971 | De Brancion | 149/2 |
| 3,673,013 | 6/1972 | Lane et al. | 149/113 X |

*Primary Examiner*—Edward A. Miller

*Attorney, Agent, or Firm*—R. S. Sciascia; W. Thom Skeer; L. E. K. Pohl

[57] ABSTRACT

A solid propellant formulation and method of preparation which has enhanced burning rate characteristics and improved mechanical properties. The formulation comprises a binder, a fuel and an inorganic oxidizer consisting of ammonium perchlorate whiskers which are oriented along the direction of shear.

4 Claims, No Drawings

EXTRUSION OF SOLID PROPELLANT INCLUDING AMMONIUM PERCHLORATE WHISKERS

BACKGROUND OF THE INVENTION

In the area of propellant formulation it has been found that metal monofilaments, if added to an uncured solid propellant so as to provide directional orientation of the filaments, result in an increase in the burning rate, impulse, etc.

At the present time no effort prior to the present invention is known for formulating a propellant with oriented asymetric inorganic oxidizer filaments such as the ammonium perchlorate whiskers described in copending patent application Ser. No. 79,680, filed Oct. 9, 1970, now U.S. Pat. No. 3,870,577. Propellants containing the oriented oxidizer showed modified burning rates and enhanced toughness which were unexpected from oriented asymetric oxidizer filaments.

DESCRIPTION OF THE INVENTION

The instant invention relates to a propellant formulation containing oriented asymetric inorganic oxidizer, more particularly ammonium perchlorate whiskers oriented along the direction of shear.

In accordance with the present invention a formulation comprising a binder, a fuel and inorganic oxidizer whiskers of micron and submicron size having a length to diameter ratio of between 10:1 and 100:1 was prepared as follows:

A binder comprising a member selected from the group consisting of polybutadiene, polyurethane, polyvinyl chloride and polybutadiene-acrylic acid copolymer was placed in a mixing pot; ammonium perchlorate whiskers were added while agitating the pot to form a mixture; the mixture was cast, then cured partially for a predetermined time to increase the viscosity of the mixture; the viscous mixture was extruded in a standard press; and the resulting strands were cured in an oven at a temperature and time dependent upon the binder used. Fuels such as aluminum may also be added at the time the oxidizer is introduced into the binder.

As described hereinabove, the blended solid oxidizer filaments used in accordance with the present invention are of micron and submicron size having a length to diameter ratio of between 10:1 and 100:1. The oxidizer filaments are whisker-like and more particularly, crystals without inclusions. They are white in color and can be stored under ambient conditions without loss of optimum ballistic performance. In contrast, ground ammonium perchlorate crystals require immediate use after grinding as they tend to agglomerate with time and aging. Ammonium perchlorate whiskers containing certain burning rate modifiers may also be incorporated into the binders and blended according to the present method. The burning rate modifiers include potassium perchlorate, ammonium permanganate, ammonium dichromate, ferrocenium perchlorate.

The following examples are presented to further illustrate the invention.

EXAMPLE I (W-1)

| Ingredients | Percent by weight |
|---|---|
| Ammonium perchlorate whiskers (25μ) | 76.190 |
| Butarez (CTL II)[1] | 23.212 |
| MAPO[2] | 0.598 |

EXAMPLE II (W-2)

| Ingredients | Percent by weight |
|---|---|
| Ammonium perchlorate whiskers (nominal 4μ) | 76.190 |
| Butarez (CTL II)[1] | 23.212 |
| MAPO[2] | 0.598 |

[1]Butarez is the tradename for a linear carboxylated polybutadiene resin. This resin is a liquid, controlled-structure polymer of butadiene characterized by the presence of carboxy end-groups on both ends of the polymer chain shown structurally as follows:

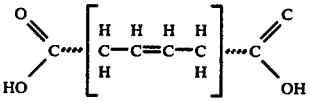

It has relatively narrow molecular weight distribution and lacks crystalizability which allows cured compositions of the polymer to remain rubbery down to very low temperatures. The resin's properties include from 1.1 to 1.4 carboxyl content, 0.05 maximum moisture, 0.05 maximum ash, 0.89 to 0.92 specific gravity and 230 to 350 poise viscosity at 77° F.

[2]MAPO is the tradename for tris[1-(2-methyl)axiridinyl]-phosphine oxide.

The ingredients set out above were mixed at room temperature in accordance with the procedure described herein and curing for the Butarez-bound composition was generally at about 135° F. for several days. The physical properties were sufficient after about 70 hours.

Test data show a burning rate of 0.6 in/sec for Example I and 1.0 in/sec at psig for Example II as compared to 0.5 in/sec for propellant formulations containing ground ammonium perchlorate. Upon orientation of these whiskers by extrusion after a partial cure (6 hours) the burning rate of Examples I and II were each increased by 20%.

Measurements of the mechanical property response of propellants containing ammonium perchlorate whiskers using the torsion-tension tester demonstrated that the whisker-containing propellant exhibits a broaded gloss to rubber transition than did the propellants containing ground ammonium perchlorate.

What is claimed is:

1. A method for preparing an improved propellant formulation comprises:
   (1) introducing a viscous binder selected from the group consisting of linear carboxylated polybutadiene, polyurethane, polyvinylchloride and polybutadiene-acrylic acid copolymer into a mixing pot;
   (2) adding while slowly agitating the pot ammonium perchlorate whiskers ranging in size from micron to below micron in diameter and having a length to diameter ratio of between 10:1 and 100:1 to form a mixture;
   (3) casting said mixture;
   (4) partially curing said mixture for a predetermined length of time at room temperature thereby increasing the viscosity thereof;
   (5) extruding said viscous mixture into strands; and
   (6) curing said strands in an oven at a predetermined temperature and for a predetermined length of time dependent upon the binder used.

2. The method in accordance with claim 1 wherein, tris[1-(2-methyl)aziridinyl]phosphine oxide is added after step (2).

3. The method in accordance with claim 2 wherein the binder consists of linear carboxylated polybutadiene.

4. The method in accordance with claim 3 to which aluminum is added to the binder prior to the addition of the ammonium perchlorate.

* * * * *